United States Patent [19]

Ohno et al.

[11] 4,407,590

[45] Oct. 4, 1983

[54] BATTERY UNIT FOR AN ELECTRIC TIMEPIECE

[75] Inventors: Hideshi Ohno, Sayama; Kazunari Kume, Tokorozawa; Takatoshi Osaka, Higashikurume; Katsuo Nishimura, Tokorozawa; Munetaka Tamaru, Tokyo; Sadao Ode, Hoya, all of Japan

[73] Assignee: Citizen Watch Co., Ltd., Tokyo, Japan

[21] Appl. No.: 177,583

[22] Filed: Aug. 13, 1980

Related U.S. Application Data

[63] Continuation of Ser. No. 967,019, Dec. 6, 1978, abandoned.

[30] Foreign Application Priority Data

| | | | |
|---|---|---|---|
| Dec. 10, 1977 | [JP] | Japan | 52-148586 |
| Dec. 15, 1977 | [JP] | Japan | 52-151055 |
| Dec. 20, 1977 | [JP] | Japan | 52-153175 |

[51] Int. Cl.[3] ..... G04B 1/00; G04C 3/00

[52] U.S. Cl. ..... 368/204; 429/98

[58] Field of Search ..... 368/88, 203, 204, 282; 429/98; 362/189

[56] References Cited

U.S. PATENT DOCUMENTS

| | | | |
|---|---|---|---|
| 2,790,893 | 4/1957 | Lane | 362/189 |
| 2,915,577 | 12/1959 | Bronstert | 58/23 BA |
| 3,601,601 | 8/1971 | Eilenberger | 362/189 |
| 3,966,498 | 6/1976 | Wuthrich | 429/98 |
| 3,971,206 | 7/1976 | Martino | 368/282 |
| 4,041,214 | 8/1977 | Salin | 429/98 |
| 4,086,752 | 5/1978 | Kishmoto | 58/23 BA |
| 4,103,483 | 8/1978 | Riley | 368/203 |
| 4,106,279 | 8/1978 | Martin et al. | 368/203 |
| 4,143,507 | 3/1979 | Ganter et al. | 58/23 BA |

FOREIGN PATENT DOCUMENTS

| | | |
|---|---|---|
| 2629106 | 1/1977 | Fed. Rep. of Germany . |
| 1488785 | 10/1977 | United Kingdom . |

*Primary Examiner*—Bernard Roskoski

*Attorney, Agent, or Firm*—Birch, Stewart, Kolasch & Birch

[57] ABSTRACT

A battery unit for an electric timepiece is disclosed in which disclosed the battery compartment is formed in the member provided in the timepiece for supporting other parts of the device and wall means of the compartment is constructed to serve as a part of the container of the battery. The supporting member of the timepiece includes a watch case such as a middle, edge portion, back, and casing ring, and an inside supporting member such as a base, base plate, bridge, substrate.

2 Claims, 21 Drawing Figures

PRIOR ART

PRIOR ART

BATTERY UNIT FOR AN ELECTRIC TIMEPIECE

This application is a continuation of copending application Ser. No. 967,019, filed on Dec. 6, 1978, now abandoned.

BACKGROUND OF THE INVENTION

The present invention relates to a battery for an electric watch and more particularly to such a battery that a portion of the battery container is comprised of the battery chamber which formed into at least a part of component parts of the watch such as watchcase, base plate, base, etc.

There has been attempted to provide a battery having a long lifetime with a small size and a high efficiency to meet the requirement for a thin and small wrist watch. However, the miniaturizing of the battery will be in conflict with the extending of the liftetime. For example, when a thin and miniaturized battery is used, the lifetime of the battery will be shortened. Therefore, it is difficult to obtain such a thin and miniaturized battery for the watch.

SUMMARY OF THE INVENTION

The principal object of the invention is to provide a battery which may be made small in size and has a long lifetime.

In accordance with the present invention, the battery is characterized in that at least a part of the wall means defining the battery compartment is constructed to serve as a part of the container of the battery.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

FIG. 7 is a sectional view of an electronic watch, and

FIG. 8 is a sectional view of a base integrated with a back,

FIG. 9 is a sectional view of an electronic watch, and

FIG. 10 is a sectional view of a base,

FIG. 11 is a plan view of the watch of the specific embodiment, and

FIG. 12 is an enlarged sectional view of the battery.

DETAILED DESCRIPTION OF THE PREFERRED EMBODIMENTS

Figure 1:
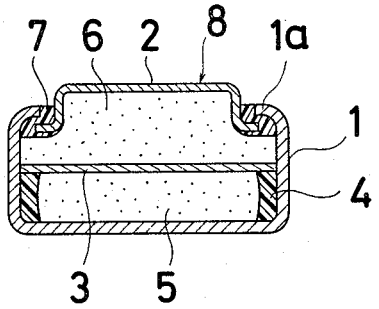
FIG. 1 PRIOR ART
FIG. 1 is a sectional view illustrating a conventional battery of the button type.

Referring now to FIG. 1, there is shown a conventional battery 8 of the button type which has been utilized in the electronic watch. The battery 8 comprises a metallic anode cup 1 with an annular supporting member 4, an anode blend 5 prepared by mixing silver oxide or silver peroxide, graphite and bonding material, a separator 3 placed on the supporting member 4, and a cathode blend 6 made of zinc, mercury, and the like. In the cathode blend, an electrolyte composed of gelatinizer and sodium hydroxide or pottasium hydroxide is added. A cathode cup 2 is mounted over these charged materials by interposing an elastic gasket 7 of insulating material, and the end 1*a* of anode cup 1 is closed to seal the battery can.

Figure 2A:
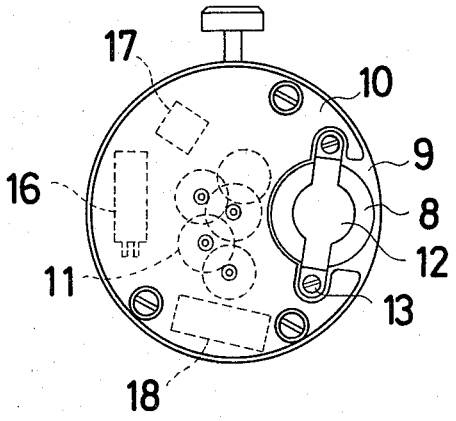
FIG. 2a PRIOR ART
FIG. 2*a* illustrates an example of the conventional electronic watch using a button type battery.
Figure 2B:
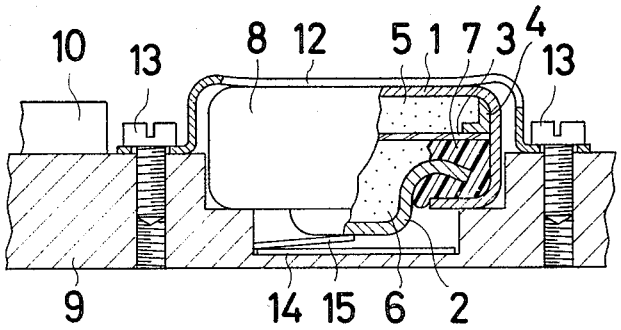
FIG. 2b PRIOR ART
FIG. 2*b* is an enlarged sectional view of the battery of FIG. 1, FIGS. 3 to 6 illustrate the first embodiment of the present invention.

FIGS. 2*a* and 2*b* illustrate an example of electronic watch using the battery 8. The battery 8 is securely attached to a base plate 9 of the watch by screws 13 with a resilient plate 12. The resilient plate 12 also serves as a conducting lead between the anode cup 1 and the base plate 9. Reference numeral 14 designates an insulating sheet of insulating material such as polyester by which a leading plate 15 of the cathode is insulated from the base plate 9. Further, reference numeral 10 indicates a bridge supporting a reduction gear train 11 used for reducing and transmitting the output power of an electro-mechanical transducer (not shown), while reference numeral 16 designates a quartz crystal oscillator for producing a time standard signal. Numeral 17 is an electronic circuit and 18 is a driving coil of the electro-mechanical transducer.

In such an arrangement as described above, since the battery has a round shape in plane, portions unable to be used remain in the watch case. The present invention is to provide a battery which may be made by effectively using a member for supporting other parts of the device in the watch.

Several exemplary embodiments of the present invention will be described in detail hereinafter with reference to the drawings.

Figure 3:
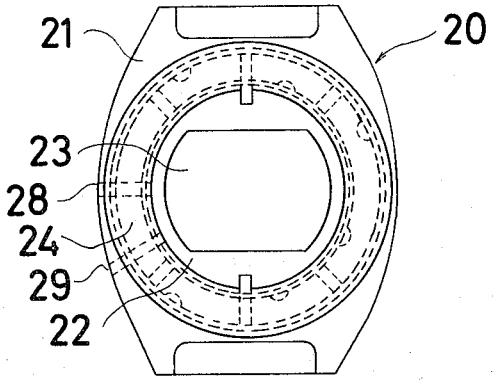
FIG. 3 is a plan view showing the rear side of the watch case.
Figure 4:
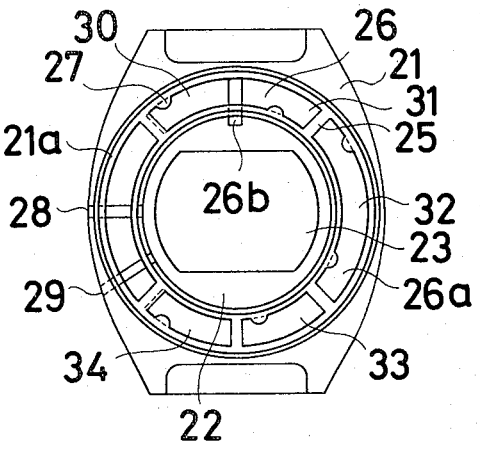
FIG. 4 is a plan view showing a rear side of the watch case.
Figure 5:
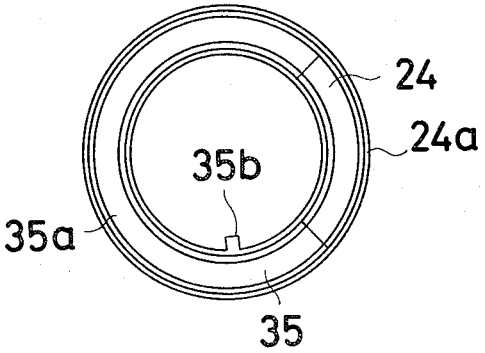
FIG. 5 is a plan view illustrating the cover of the battery chamber.
Figure 6:
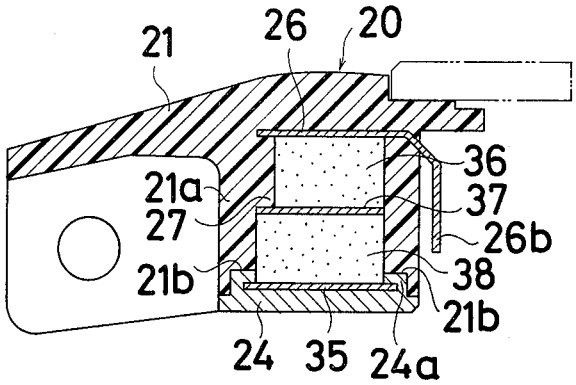
FIG. 6 is a sectional view of a part of the embodiment in FIG. 3.

FIGS. 3, 4, 5 and 6 illustrate the first embodiment of the invention in which battery units are formed in the edge of the watch case of timepiece 20. In FIG. 4, reference numeral 21 designates the watch case made of synthetic resin, in which a space 22 for containing a module of the electronic watch and display window 23 are formed. In the annular edge 21*a* (FIG. 6) battery chambers 30, 31, 32, 33 and 34 are provided and partitioned by ribs 25 each of which serves as a reinforcement member. Numeral 26 designates an anode plate which, as shown in FIG. 6, is molded integral with the watch case. The battery portion 26*a* of the anode plate 26 is exposed in the battery chamber and outer lead portion 26*a* is also exposed to the space 22. Through this lead portion 26*b*, electric power may be supplied to the electronic circuit (not shown) of the watch module. Shoulder 27 is formed within each battery for supporting a separator 37. Radial apertures 28 and 29 are provided in the annular edge of the watch case to insert external operating member such as a winding stem, push button, etc.

Referring to FIGS. 3, 5 and 6, there is an annular cover 24 made of synthetic resin for covering battery chambers 30, 31, 32, 33 and 34, which is molded integral with an electrode plate 35 at the cathode. The electrode 35 has a battery portion 35*a* exposed to the battery chamber and lead portion 35*b* exposed to the space 22. The lead portion 35*b* is used for supplying the electric power to the electronic circuit of the watch module. Numeral 36 is an anode blend including silver oxide or silver peroxide as its principal constituent and further including graphite and bonding material. Numeral 38 is a cathode blend including zinc oxide as its principal component.

Describing the process for manufacturing of the battery, each of battery chambers 30, 31, 32, 33 and 34 is charged with the anode blend 36 and an electrolyte prepared from sodium hydroxide or potassium hydroxide is added thereto. The separator 37 is engaged with the shoulder 27 and the space beneath the separator is filled with the cathode blend 38 and further an electrolyte is added to the charged cathode blend. Subsequently, the cover 24 is placed on the battery chambers 30, 31, 32, 33 and 34 pressing the cathode plate 35 against to the cathode blend 38 and then the cover is sealed. The edge portion 21*a* has shoulders 21*b* and the cover 24 has annular projections 24*a* corresponding to the shoulders. Both portions 21*b* and 24*a* are engaged with each other and joined by adhesives, supersonic welding or laser welding.

In accordance with this embodiment, it is possible to use the edge portion of the watch case as a space for making the battery, and the material of the watch case is used as a cup of the battery. Therefore, a battery having a large capacity may be manufactured without increasing the thickness of the watch.

Figure 7:
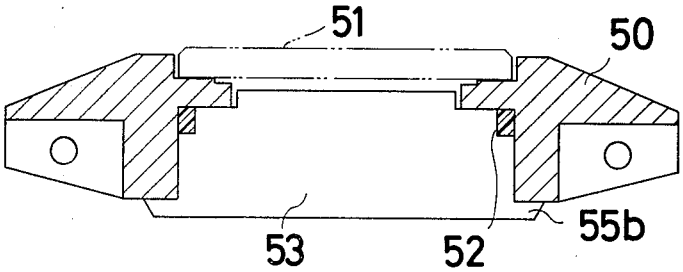
FIGS. 7 and 8 illustrate the second exemplary embodiment of the invention.
Figure 8:
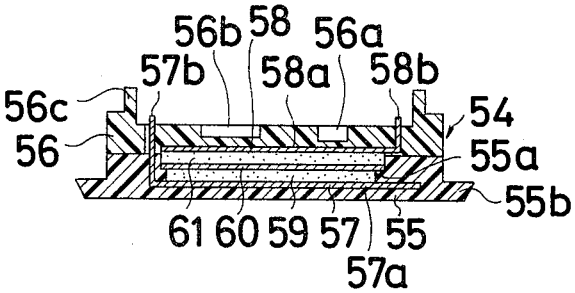

Referring to FIGS. 7 and 8 showing the second embodiment of the present invention, the battery is made in the back of the watch case. The electronic watch comprises a watch case 50, a glass 51, a module 53 and a packing 52 for sealing the module. The module 53 has a base 54 integral with a back cover. The base 54 comprises a first base 55 made of resin which is provided with a battery chamber 55*a* and a flange 55*b* as the back cover, and a second base 56 made of resin which is provided with spaces 56*a* and 56*b* for the time standard signal generating oscillator and semiconductor integrated circuit and with a shoulder 56*c* for the packing 52. An electrode 57 is embeded by molding in the first base 55 exposing the battery portion 57*a* to the battery space and the terminal portion 57*b* is projected outside, and another electrode 58 is embeded by moding in the second base 56 exposing the battery portion 58*a* to the outside and the terminal portion 58*b* is projected.

The battery chamber 55*a* of the first base 55 is charged with the anode blend 59 on which the separator 60 is put. Further, the cathode blend 61 is packed and electrolyte is added thereto. The second base 56 is engaged with the first base and sealed, so that the base 54 with the back may be provided. In this battery, the electrode 57 serves as anode and the electrode 58 is cathode. If the watch case 50 is made of resin, the flange 55*b* of the module 53 may be joined to the watch case by welding such as the supersonic welding to provide an electronic watch having a high sealing effect.

It will be understood that the conventional button type battery may be provided in the module together with the battery of the present invention and that the battery such as the first embodiment may also be provided in the watch case together with the battery in the base.

Figure 9:
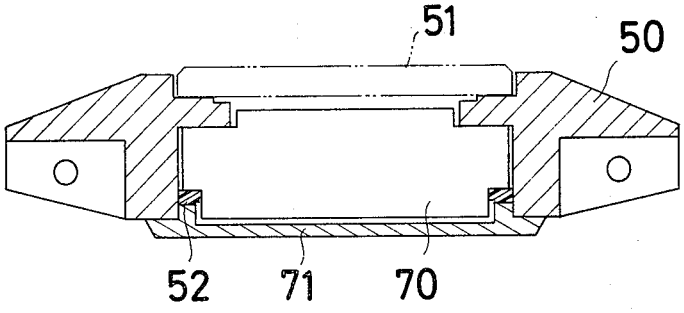
FIG. 9 and FIG. 10 illustrate the third embodiment of the present invention.
Figure 10:
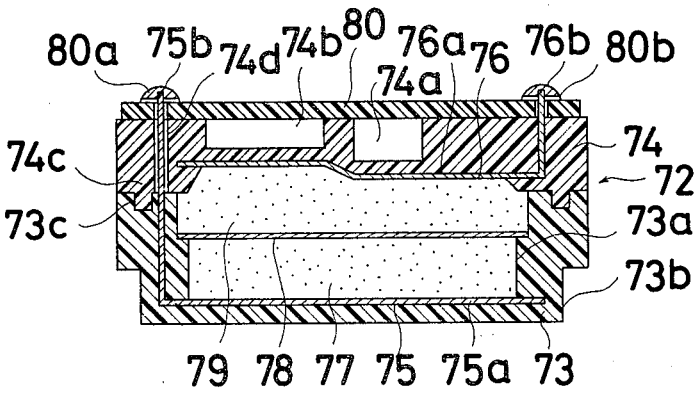

FIGS. 9 and 10 show the third embodiment of the present invention in which the battery is provided in the base of the electronic watch. Numeral 70 is a watch module including a base 72 provided with a battery, 71 is a back, 73 is a first base of the module made of resin which has a battery chamber 73*a*, a shoulder 73*b* for the packing 52 and an annular groove 73*c*. 74 is a second base made of resin which has spaces 74*a* and 74*b* for a time standard signal generating oscillator and semiconductor integrated circuit, an annular projection 74*c* and a hole 74*d* for the terminal. An electrode 75 is embedded in the first base 73 exposing the battery portion 75*a* and terminal portion 75*b*, another electrode 76 is embedded in the second base 74 exposing the battery portion 76*a* and terminal portion 76*b*.

Method of making the battery is same as the previous second embodiment. The anode blend 77 and cathode blend 79 are separated by the separator 78, the second base 76 is engaged with the first base 73 engaging the projection 74*c* with the groove 73*c* and joined by adhesives or welding. A substrate 80 provided with the time standard signal generating oscillator, semiconductor integrated circuit and the like is mounted on the base 72 and terminals 80*a* and 80*b* are joined to the terminals 75*b* and 76*b*, respectively.

It will be understood that the battery chamber 73*a* may be designed to suitable shape such as round and other any shape, so that proper portion of the base except the spaces 74*a* and 74*b* may be used for the battery.

Figure 11:
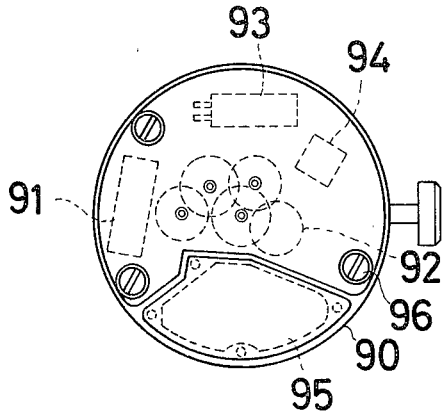
FIGS. 11 and 12 illustrate the fourth embodiment of the invention.
Figure 12:
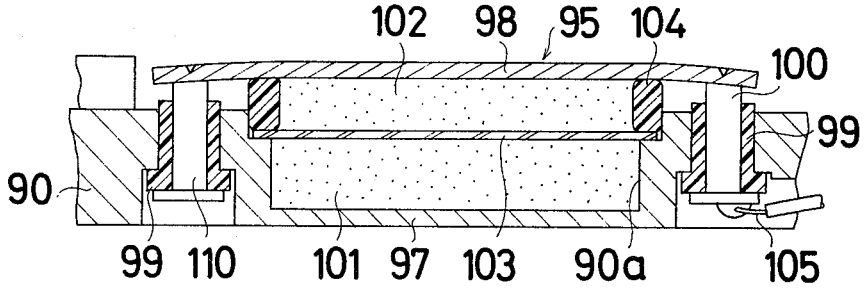

FIGS. 11 and 12 illustrate the fourth embodiment of the invention in which the battery is provided in the base plate of the watch. In FIG. 11, numerals 90 and 91 designate a metallic base plate and a driving coil of the electro-mechanical transducer respectively and numeral 92 indicates a reduction gear train used for transmitting the output power of the transducer. Numeral 93 indicates a quartz oscillator and numerals 94, and 95 designate an electronic circuit and a battery, respectively. As shown in FIG. 11, the battery 95 has such a planar configuration that one side of the periphery extends along the periphery of the base plate 90 and other sides are shaped to avoid the interference with the reduction gear train 92 and screws 96. An anode cup 97 is provided in the base plate by forming a recess to provide a battery chamber 90*a* and a cathode cup 98 is spot-welded to shafts 100 each of which is fixed on the base plate 90 by interposing a tube 99 made of insulating material. Anode blend 101 and the cathode blend 102 are pelletized, and each of blends 101 and 102, a separator 103 and a gasket 104 has a shape similar to that of the battery in FIG. 11. Since the gasket 104 is provided to serve as insulation and sealing, it may be made into a simple sectional shape such as oval compared with the gasket 7 in FIG. 2*b*. Further, since the anode cup 1, the resilient plate 12, the insulating sheet 14 and the leading plate 15 are omitted, it is possible to provide a large space for the battery. In this case, the replacement of its battery is not considered, since a battery having a long lifetime may be provided. Numeral 105 designates a lead wire to the cathode and the conduction of the anode is provided through the base plate 90.

Figure 13:
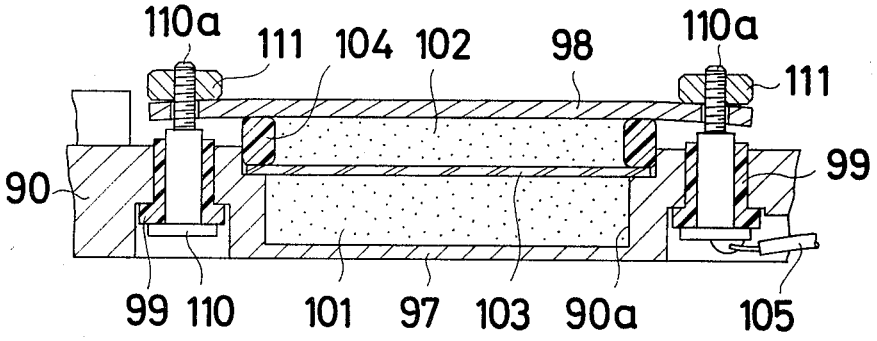
FIG. 13 is a sectional view illustrating the fifth embodiment of the present invention.

FIG. 13 shows the fifth embodiment of the invention, which is provided to allow the replacement of the anode and cathode. In this example, the cathode cup 98 is fixed with nuts 111 on thread portions 110*a* of shafts 110 projected on the cup 98. Since the functions of the other component parts are respectively identical to that of those described in the fourth example, the same part is identified with the same number as that of FIG. 12.

Figure 14:
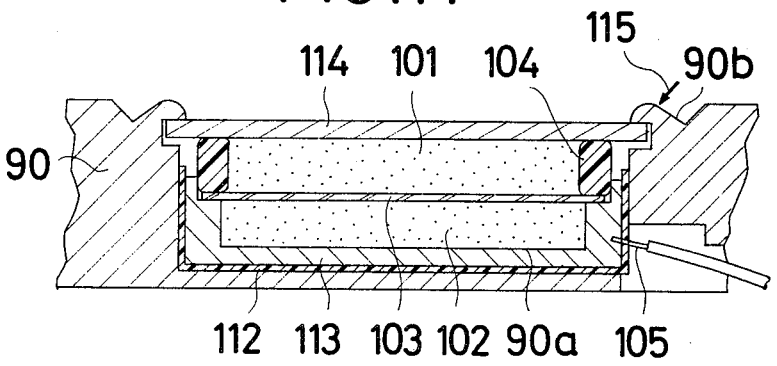
FIG. 14 is a sectional view illustrating the sixth embodiment of the present invention.

FIG. 14 shows the sixth embodiment of the invention. In this embodiment, a cathode cup 113 is engaged with a recess 90*a* formed in a base plate 90 with interposing an insulation 112. An anode cup 114 mounted on a gasket 104 and an anode blend 101 is secured to the base plate 90 by bending the edge portion of a groove 90*b* provided in the base plate 90 in the direction of the arrow 115. Numeral 105 designates a lead wire to the cathode and conduction of the anode is effected by the base plate 90.

Figure 15:
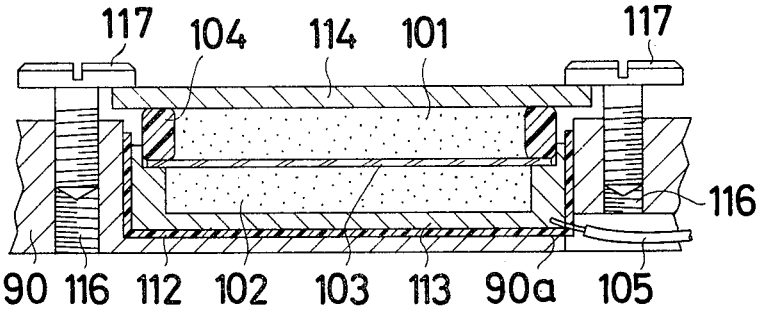
FIG. 15 is a sectional view illustrating the seventh embodiment of the invention.

FIG. 15 shows the seventh embodiment of the present invention which is provided so as to permit the replacement of the blends. In this example, the anode cup 114 placed on the gasket 104 is fixed by fastening screws 117 engaged with holes 116.

Figure 16:
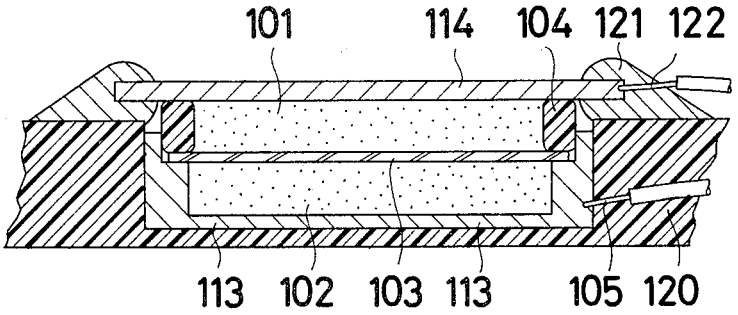
FIG. 16 is a sectional view illustrating the eighth embodiment of the invention.
Figure 17:
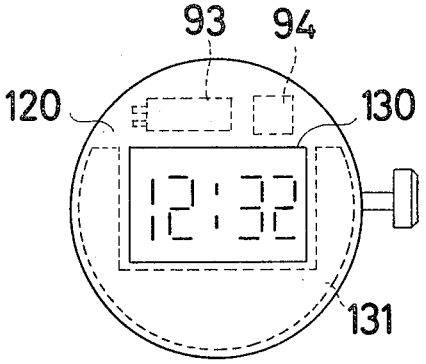
FIG. 17 is a plan view illustrating an electronic watch provided with the ninth embodiment of the present invention.

FIG. 16 illustrates the eighth example of the invention. The cathode cup 113 is embedded in the watch base plate 120 made of insulating material such as synthetic resins. The anode cup 114 placed on the gasket 104 is pressed against the blends by a jig and fixed to the base plate by adhesives 121. The lead wire 105 to the cathode and the lead wire 122 to the anode are connected to the cathode cup 113 and the anode cup 114, respectively. In this embodiment, since the watch base plate 120 is made of insulating material, the insulating member 112 in the sixth or seventh embodiment may be removed, whereby the capacity of the battery can be increased.

FIG. 7 is a plan view illustrating the ninth embodiment of this invention, wherein the battery is applied to a digital watch employing an electro-optical display device such as a light emitting diode and a liquid crystal display device. The sectional construction of the battery of this embodiment may be selected from the embodiments in FIGS. 12 to 16. Numeral 131 designates a battery which is provided in the watch base plate 120 surrounding the display device 130. In this embodiment, the battery may occupy large space except the space for the display device 130, quartz oscillator 93 and circuit 94. Thus, capacity of battery may be greatly increased.

Figure 18:
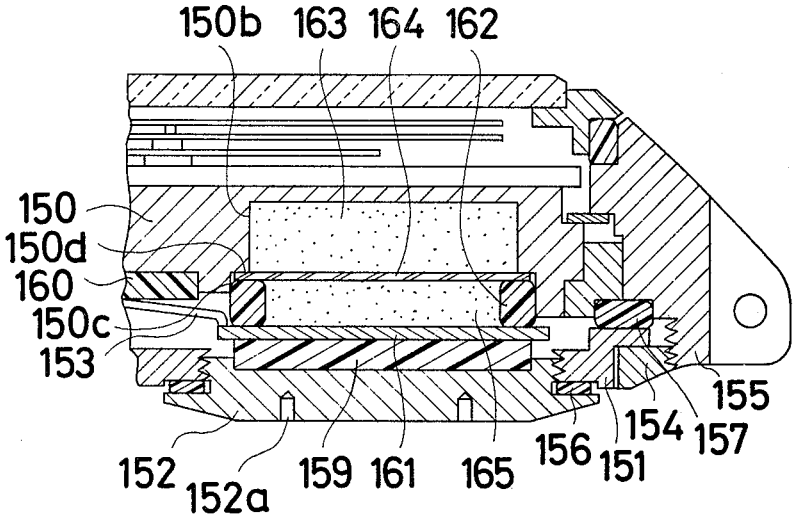
FIG. 18 is a sectional view illustrating the tenth embodiment of the present invention.

FIG. 18 illustrates the tenth embodiment of the present invention in which the battery container is constructed from the base of the watch module and from the battery compartment cover which is a part of the watch case. Reference numeral 150 designates base plate made of conductive material, in which a large diameter recess 150*c* and a small diameter recess 150*b* are provided. The base plate acts as the anode cup of the battery and the shoulder portions 150*d* serve as a supporting shoulder for a separator 164. A battery compartment cover 152 is secured to a back 151 by means of threads interposing a packing 156. The back 151 is secured to a middle 155 of the watch case with a screw ring 154 interposing a packing 157. A cathode cup 161 is joined to the battery compartment cover 152 interposing a spacer 159 made of non-conductive material, and a gasket 162, cathode blend 165, separater 164 and anode blend 163 are forced into the recess 150*b* and 150*c* by the cathode cup 161. Holes 152*a* are provided for screwing battery compartment cover 152 with a jig. A cathode contact 153 is provided on the base plate 150 insulated by a member 160 made of non-conductive material and is in contact with the cathode cup 161. Conduction of anode is effected by the base plate 150 without the lead. If the anode blend 163 and the cathode blend 165 are solidified respectively or packed together with the separator 164, it may be expected to facilitate the replacement of the blends.

Figure 19:
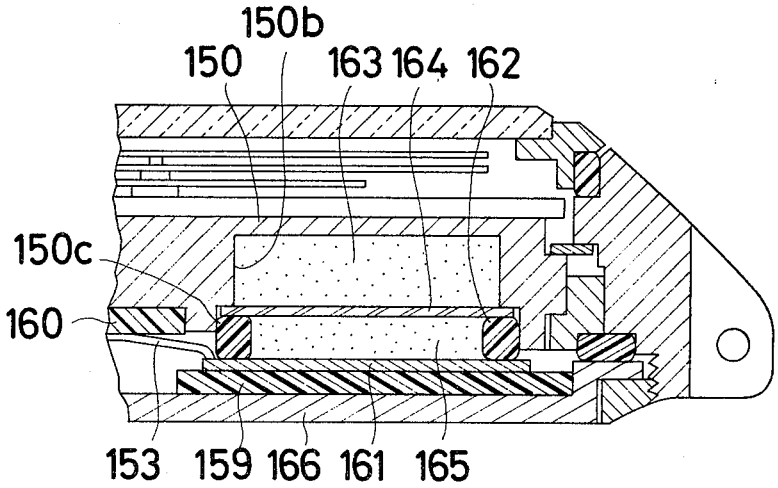
FIG. 19 is a sectional view illustrating the eleventh embodiment of the invention.

FIG. 19 is a sectional view of the eleventh embodiment of the present invention. In the embodiment, the cathode cup 161 is secured to a back 166 interposing the spacer 159 for pressing the gasket 162, cathode blend 165, separator 164 and anode blend 163 into the recess 150*b* and 150*c* of the base plate 150. This embodiment has such advantages that this arrangement is applicable to the watch without battery compartment cover 152 and the thickness of watch case may be greatly reduced without a reduction of the capacity of the battery.

Figure 20:
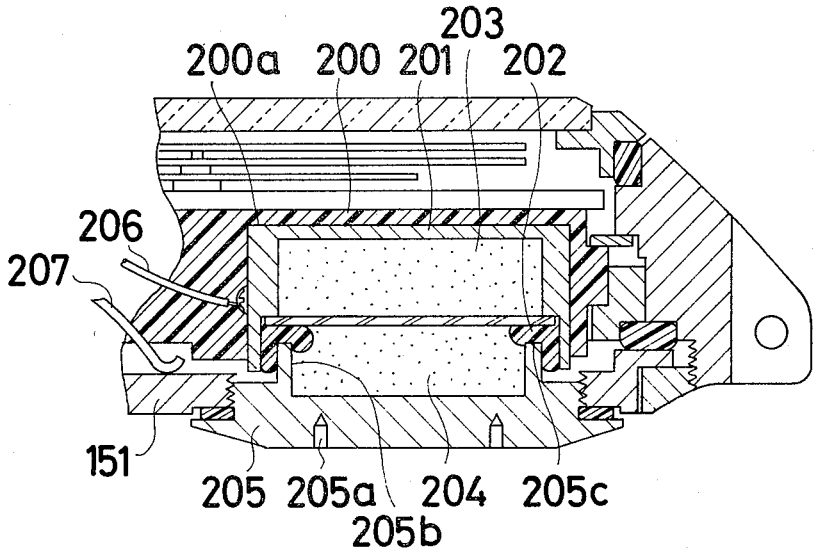
FIG. 20 is a sectional view illustrating the twelfth embodiment of the invention.

FIG. 20 is a sectional view of the twelfth embodiment of the invention. Numeral 200 designates a substrate made of non-conductive material in which a battery compartment 200*a* is provided. An anode cup 201 is engaged with the compartment by molding and charged with an anode blend 203. A battery compartment cover 205 has a battery chamber 205*b* which is filled with a cathode blend 204. Further the cover 205 is provided with an annular projection 205*c* arranged in the periphery of the battery chamber 205*b*, which is pressed against the gasket 202. Numeral 205*a* designates holes used for inserting a special jig to rotate the battery compartment cover 205. Conduction of the anode is effected through a lead wire 206 connected to the anode cup 201 and the conduction of the cathode is achieved by contacting the back 151 to a lead plate 207 molded integral with the substrate 200.

Figure 21:
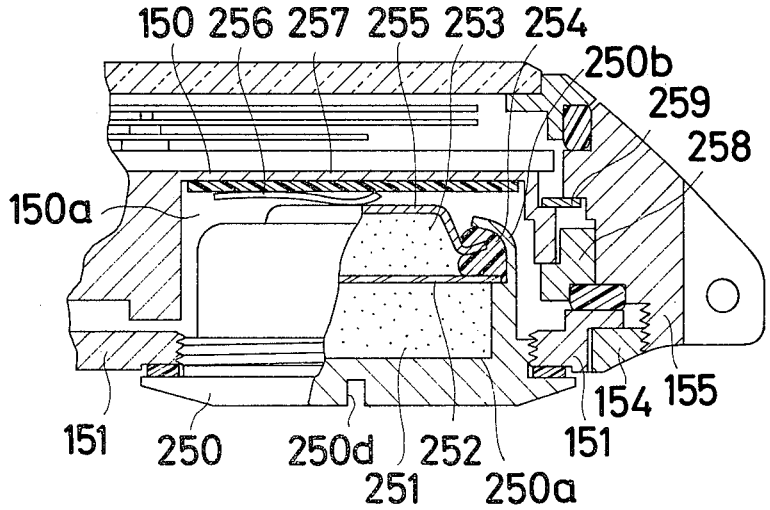

FIG. 21 is a sectional view of the thirteenth embodiment of the invention, in which a battery is formed in the battery compartment cover. A battery compartment cover 150 has a battery chamber 250*a* which is filled with an anode blend 251 and cathode blend 253 interposing a separator 252. A cathode cup 255 is engaged with a gasket 254 and fixed by bending the annular projection 250*b* provided on the periphery of the battery compartment cover 250. A lead plate 256 is attached to an insulating sheet 257 of non-conductive material mounted in the recess 250*a* formed in the base plate 150. The conduction of the anode may be achieved through the battery compartment cover 250, back 151, screw ring 154, middle 155, casing ring 258 or fixing ring 259, and base plate 250.

To replace the battery, it is possible to change the battery compartment cover 250. The battery compartment cover may be easily removed by rotating the cover 250 with suitable tool engageable with a groove 250*d*. Although the invention has been described in the exemplary embodiments concerning an analog watch with pointers and a degital watch using an electro-optical display device, it is possible to apply this invention to such a watch employing both of the pointer and the electro-optical display device without difficulties. It will be understood that configuration of the battery may be suitably designed without being limited to the shapes shown in the specific embodiments, and further it is possible to provide a battery having an irregular thickness.

Furthermore, it is possible to exchange the position of the anode cup with the cathode cup and to engage another metal with the recess provided in the base plate or watch case for making the metal into the electrode.

From the foregoing, it will be understood that the present invention may provide a battery of which at least a part of component parts is provided by a part of the watch components such as watch case, base plate, base and the like, whereby a battery having a larger capacity may be obtained and the extending of its lifetime can be achieved while at the same time a thin and small watch may be provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An electric timepiece comprising a watch case and a battery unit forming an integral part of said electric timepiece, said watch case having a back and front portion made of a plastic material, said battery unit comprising at least one battery chamber formed in an edge portion of said watch case having a battery component, a removable cover made of a plastic material for covering said battery chamber at the back of said watch case, said battery component comprising a first electrode embedded in said edge portion of said watch case at a top portion of said battery chamber integral with said front portion of said watch case, a second electrode embedded in said cover, an anode blend and cathode blend provided in said battery chamber between said electrodes and a separator held on a shoulder formed in said edge portion of said watch case in said battery chamber so as to separate said anode and cathode blends, said cover being separable from said anode and cathode blends.

2. The electric timepiece of claim 1, wherein said at least one battery chamber is divided by ribs into a plurality of battery chambers, each of said chambers being provided with a respective battery component, the electrodes thereof being connected in parallel.

* * * * *